US009062920B2

(12) United States Patent
Hsieh

(10) Patent No.: US 9,062,920 B2
(45) Date of Patent: Jun. 23, 2015

(54) HEAT PIPE WITH SEALED VESICLE

(75) Inventor: Yi-Shih Hsieh, New Taipei (TW)

(73) Assignee: Foxconn Technology Co., Ltd., New Taipei (TW)

( * ) Notice: Subject to any disclaimer, the term of this patent is extended or adjusted under 35 U.S.C. 154(b) by 269 days.

(21) Appl. No.: 13/532,806

(22) Filed: Jun. 26, 2012

(65) Prior Publication Data

US 2013/0081787 A1 Apr. 4, 2013

(51) Int. Cl.

| | |
|---|---|
| ***H01L 23/473*** | (2006.01) |
| ***F28D 15/04*** | (2006.01) |
| ***F28D 15/02*** | (2006.01) |

(52) U.S. Cl.

CPC ..... *F28D 15/02* (2013.01); *F28D 15/0241* (2013.01); *F28D 15/025* (2013.01)

(58) Field of Classification Search

CPC ..... F28D 15/02; F28D 15/04; F28D 15/0241; F28D 15/025; H01L 27/473

USPC ..... 165/104.21, 104.26, 104.33, 46, 83, 165/104.27

See application file for complete search history.

(56) References Cited

U.S. PATENT DOCUMENTS

| | | | | |
|---|---|---|---|---|
| 4,212,347 | A * | 7/1980 | Eastman | 165/46 |
| 4,279,294 | A * | 7/1981 | Fitzpatrick et al. | 165/45 |
| 4,971,138 | A * | 11/1990 | Lowenstein | 165/46 |
| 5,168,921 | A * | 12/1992 | Meyer, IV | 165/104.14 |
| 5,720,338 | A * | 2/1998 | Larson et al. | 165/46 |
| 6,446,706 | B1 * | 9/2002 | Rosenfeld et al. | 165/46 |
| 6,679,318 | B2 * | 1/2004 | Bakke | 165/104.26 |
| 7,520,315 | B2 * | 4/2009 | Hou et al. | 165/104.26 |
| 2006/0086482 | A1 * | 4/2006 | Thayer et al. | 165/104.26 |
| 2006/0196641 | A1 | 9/2006 | Hong et al. | |

FOREIGN PATENT DOCUMENTS

| | | |
|---|---|---|
| CN | 101968327 A | 2/2011 |
| TW | 452117 | 8/2001 |

* cited by examiner

*Primary Examiner* — Allen Flanigan
*Assistant Examiner* — For K Ling
(74) *Attorney, Agent, or Firm* — Novak Druce Connolly Bove + Quigg LLP

(57) ABSTRACT

A heat pipe includes a sealed casing, a sealed vesicle received in the sealed casing, and a working fluid contained in the sealed vesicle. The sealed casing includes an evaporating section, a condensing section, and a connecting section connecting the evaporating section and the condensing section. The sealed vesicle is made of soft metal. The sealed vesicle comprising a heat absorbing portion attached to the evaporating section, a heat dissipating portion attached to the condensing section, and an uneven portion connecting the heat absorbing portion and the condensing section.

10 Claims, 3 Drawing Sheets

HEAT PIPE WITH SEALED VESICLE

BACKGROUND

1. Technical Field

The disclosure relates to heat pipes, and particularly to a heat pipe comprising a sealed vesicle therein.

2. Description of the Related Art

Heat pipes have excellent heat transfer performance due to their low thermal resistance, and are therefore an effective means for transfer or dissipation of heat from heat sources. Currently, heat pipes are widely used for removing heat from heat-generating components such as central processing units (CPUs) of computers, especially in a notebook computer having a smaller inner space therein. Preferably, a wick structure is attached to an inner surface of the heat pipe for drawing the working medium back to the evaporator section after it is condensed at the condenser section. An inner surface of the wick structure defines a vapor channel through which vapor moves from the evaporator section toward the condenser section. With the notebook computer becoming smaller and smaller, a size of the vapor channel is greatly reduced. Thus, the vapor can not flow fluently from the evaporator section toward the condenser section via the vapor channel, thereby decreasing the heat transfer capability of the heat pipe.

Therefore, it is desirable to provide a heat pipe with an improved heat transfer capability to overcome the above mentioned shortcoming.

BRIEF DESCRIPTION OF THE DRAWINGS

The components of the drawings are not necessarily drawn to scale, the emphasis instead being placed upon clearly illustrating the principles of the embodiments of the display device. Moreover, in the drawings, like reference numerals designate corresponding parts throughout several views.

DETAILED DESCRIPTION

Figure 1:
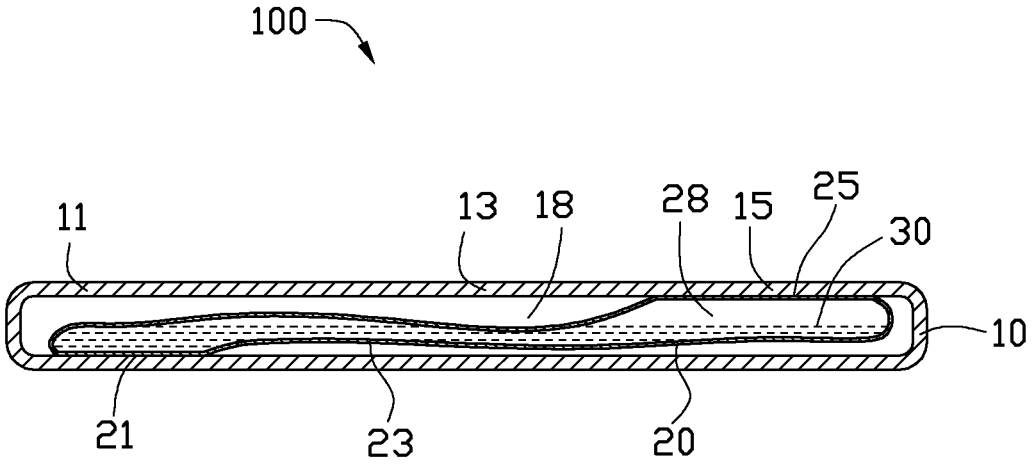
FIG. 1 is a longitudinally cross-sectional view of a heat pipe in accordance with a first embodiment of the present invention.

Referring to FIG. 1, a heat pipe 100 in accordance with a first embodiment of the disclosure is shown. The heat pipe 100 includes a sealed casing 10, a sealed vesicle 20 received in the casing 10 and partially contacting an inner surface of the casing 10, and a working fluid contained in the sealed vesicle 20.

In this embodiment, the heat pipe 100 is a straight heat pipe with a round transverse-section. Alternatively, the heat pipe 100 can be a flat heat pipe. The casing 10 is made of metal having a good thermal conductivity, such as copper. The casing 10 defines a sealed receiving space 18 therein. The casing 10 is evacuated and hermetically sealed. The casing 10 includes an evaporating section 11, a condensing section 15, and a connecting section 13 connecting the evaporating section 11 and the condensing section 15.

The sealed vesicle 20 is made of soft metal to have good ductility and malleability. In this embodiment, the sealed vesicle 20 is made of copper foil or aluminum foil. The sealed vesicle 20 extends from the evaporating section 11 to the condensing section 15. The sealed vesicle 20 includes a heat absorbing portion 21 in the evaporating section 11, a heat dissipating portion 25 in the condensing section 15, and uneven portion 23 in the connecting section 13. The heat absorbing portion 21 and the heat dissipating portion 25 are mounted on and flatly contact the inner surface of the casing 10. In this embodiment, the heat absorbing portion 21 tightly contacts a bottom of the inner surface of the evaporating section 11, and the heat dissipating portion 25 tightly contacts a top of the inner surface of the condensing section 15. Since the sealed vesicle 20 shrinks in a normal state, the uneven portion 23 of the sealed vesicle 20 are spaced from the inner surface of the casing 10.

The sealed vesicle 20 defines a sealed cavity 28 therein. The sealed vesicle 20 is evacuated and hermetically sealed after the working medium 30 is injected into the sealed vesicle 20. The working medium 30 is usually selected from a liquid such as water, methanol, or alcohol, which has a low boiling point. Thus, the working medium 30 can easily evaporate to vapor when it receives heat at the heat absorbing portion 21 of the sealed vesicle 20 and the evaporating section 11.

Figure 2:
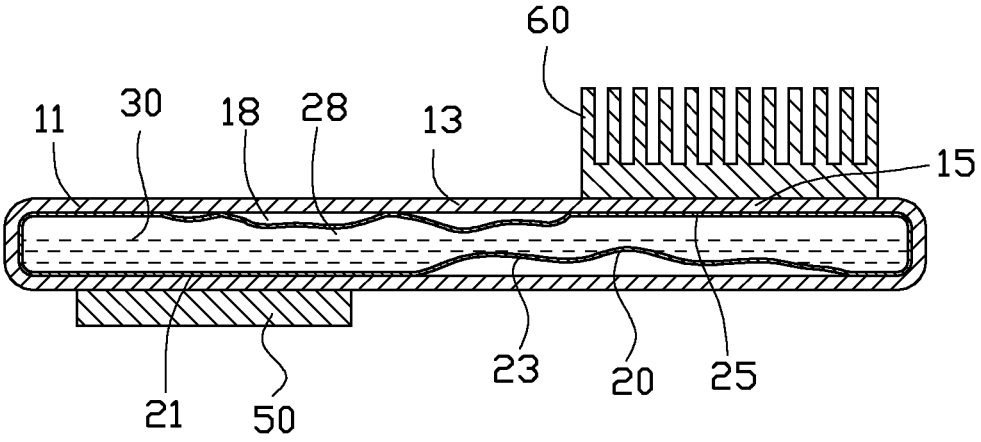
FIG. 2 is a view similar to FIG. 1, wherein the heat pipe connects a heat-generating component and a heat sink in a work state.

Referring to FIG. 2, in use, the evaporating section 11 is placed in thermal contact with a heat-generating component 50, which needs to be cooled. A heat sink 60 is mounted on the condensing section 15. The working medium contained in the heat absorbing portion 21 of the sealed vesicle 20 is vaporized into vapor upon receiving the heat generated by the heat-generating component 50. The generated vapor expands the sealed vesicle 20 to form a channel (not labeled) in the sealed cavity 28. Then, the generated vapor moves from the heat absorbing portion 21 to the heat dissipating portion 25. Since some portions of the sealed vesicle 20 contact the inner surface of the casing 10 and other portions of the sealed vesicle 20 are spaced to the inner surface, the uneven portion 23 of the sealed vesicle 20 surrounding the channel is curved and waved to function as a wick. After the vapor releases the heat carried thereby and is condensed into condensate in the condensing section 15, the condensate flows through the channel to the heat absorbing portion 21 via the uneven portion 23 of the sealed vesicle 20. As a result, the condensate is drawn back to the heat absorbing portion 21 rapidly and timely without any wick, thus preventing a potential dry-out problem occurring at the evaporating section 11 of the heat pipe 100. Since the sealed vesicle 20 of the heat pipe 100 has small thickness than a heat pipe using a wick structure, the heat pipe 100 has a small size and good heat transfer capability.

Figure 3:
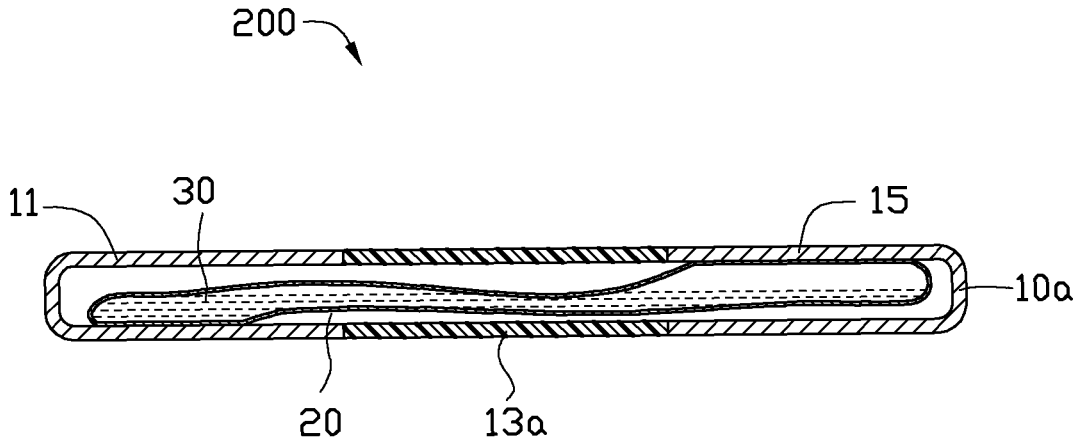
FIG. 3 is a longitudinally cross-sectional view of a heat pipe in accordance with a second embodiment of the present invention.

Referring to FIG. 3, a heat pipe 200 in accordance with a second embodiment of the disclosure is shown. The heat pipe 200 comprises a sealed casing 10*a*, a sealed vesicle 20 received in the casing 10*a*, and a working fluid contained in the sealed vesicle 20. Difference from the casing 10 of the heat pipe 100 of the first embodiment, the casing 10*a* of the heat pipe 200 comprises an evaporating section 11, a condensing section 15, and a flexible connecting section 13*a* connecting the evaporating section 11 and the condensing section 15. The flexible connecting section 13*a* is made of flexible material, such as rubber or plastic. Simultaneously, the sealed vesicle 20 has good ductility and malleability; thus, the flexible connecting section 13*a* can be bent to adjust an angle between the evaporating section 11 and the condensing section 15.

It is to be further understood that even though numerous characteristics and advantages have been set forth in the foregoing description of the embodiment(s), together with details of the structures and functions of the embodiment(s), the disclosure is illustrative only; and that changes may be made in detail, especially in the matters of shape, size, and arrangement of parts within the principles of the disclosure to the full extent indicated by the broad general meaning of the terms in which the appended claims are expressed.

What is claimed is:

1. A heat pipe, comprising:

a hermetically sealed casing comprising an evaporating section, a condensing section, and a connecting section connecting the evaporating section and the condensing section;

a sealed vesicle received in the hermetically sealed casing, the sealed vesicle being made of soft metal, the sealed vesicle comprising a heat absorbing portion attached to the evaporating section, a heat dissipating portion attached to the condensing section, and an uneven portion connecting the heat absorbing portion and the heat dissipating portion; and a working fluid contained in the sealed vesicle;

wherein when the sealed vesicle shrinks in a normal state, the uneven portion of the sealed vesicle is spaced from an inner surface of the hermetically sealed casing, and the uneven portion of the sealed vesicle is curved and waved to function as a wick.

2. The heat pipe of claim 1, wherein the sealed vesicle is made of copper foil.

3. The heat pipe of claim 1, wherein the connecting portion section of the hermetically sealed casing is made flexible material.

4. The heat pipe of claim 3, wherein the flexible connecting section is bent to adjust an angle between the evaporating section and the condensing section.

5. The heat pipe of claim 3, wherein the evaporating section and the condensing section are made of copper.

6. A heat pipe, comprising:

a hermetically sealed casing comprising an evaporating section, a condensing section, and a connecting section connecting the evaporating section and the condensing section;

a sealed vesicle received in the hermetically sealed casing, the sealed vesicle being made of soft metal, the sealed vesicle comprising a heat absorbing portion attached to the evaporating section, and a heat dissipating portion attached to the condensing section; and a working fluid contained in the sealed vesicle;

wherein the working medium fluid contained in the heat absorbing portion of the sealed vesicle is vaporized into vapor upon receiving heat, the generated vapor expanding the sealed vesicle to form an uneven structure with a channel, the working medium fluid condensed in the heat dissipating portion flowing through the channel to the heat absorbing portion via the uneven structure of the sealed vesicle; and wherein when the sealed vesicle shrinks in a normal state, the uneven structure of the sealed vesicle is spaced from an inner surface of the hermetically sealed casing, and the uneven structure of the sealed vesicle surrounding the channel is curved and waved to function as a wick.

7. The heat pipe of claim 6, wherein the sealed vesicle is made of copper foil.

8. The heat pipe of claim 6, wherein the connecting section of the hermetically sealed casing is made flexible material.

9. The heat pipe of claim 8, wherein the connecting section is bent to adjust an angle between the evaporating section and the condensing section.

10. The heat pipe of claim 8, wherein the evaporating section and the condensing section are made of copper.

* * * * *